US008170219B2

(12) United States Patent
Sandberg

(10) Patent No.: US 8,170,219 B2
(45) Date of Patent: May 1, 2012

(54) SIZE ADJUSTABLE DEVICE AND METHOD

(75) Inventor: Karin Sandberg, Vellinge (SE)

(73) Assignee: Sony Ericsson Mobile Communications AB, Lund (SE)

( * ) Notice: Subject to any disclaimer, the term of this patent is extended or adjusted under 35 U.S.C. 154(b) by 1131 days.

(21) Appl. No.: 12/020,243

(22) Filed: Jan. 25, 2008

(65) Prior Publication Data

US 2009/0190785 A1 Jul. 30, 2009

(51) Int. Cl.
*H04R 25/00* (2006.01)
*H04R 1/20* (2006.01)

(52) U.S. Cl. ..... 381/23.1; 381/322; 381/324; 381/329; 381/345; 381/380

(58) Field of Classification Search ..... 381/23.1, 381/322, 324, 329, 345, 380
See application file for complete search history.

(56) References Cited

U.S. PATENT DOCUMENTS

| | | | | |
|---|---|---|---|---|
| 3,935,401 | A | 1/1976 | Shore et al. | |
| 5,231,659 | A * | 7/1993 | Abraham et al. | 379/433.03 |
| 6,129,174 | A * | 10/2000 | Brown et al. | 181/135 |
| 2007/0036383 | A1 | 2/2007 | Romero | |
| 2008/0144878 | A1 * | 6/2008 | Oliveira et al. | 381/380 |
| 2009/0233652 | A1 * | 9/2009 | Yang | 455/569.1 |
| 2010/0061580 | A1 * | 3/2010 | Tiscareno et al. | 381/380 |
| 2010/0246878 | A1 * | 9/2010 | Sim et al. | 381/380 |

FOREIGN PATENT DOCUMENTS

| | | | |
|---|---|---|---|
| CA | 2 419 950 | A1 | 2/2003 |
| EP | 0 360 517 | A2 | 3/1990 |
| EP | 1 058 479 | A2 | 12/2000 |
| EP | 1 594 340 | A1 | 11/2005 |
| WO | WO 02/25994 | A1 | 3/2002 |
| WO | WO 2007/022634 | A1 | 3/2007 |

OTHER PUBLICATIONS

International Search Report issued for corresponding international application No. PCT/EP2008/057627, mailed Oct. 13, 2008, 3 pages.

* cited by examiner

*Primary Examiner* — Ngan Ngo
(74) *Attorney, Agent, or Firm* — Harrity & Harrity, LLP

(57) ABSTRACT

One or more embodiments may provide for a size adjustable earphone that may include a foldable sleeve attached to an earphone housing. A first end of the foldable sleeve may embrace the earphone housing, where an opposite second end of the foldable sleeve may be adapted to be folded. The foldable sleeve may be adapted to be kept in a first unfolded position, providing the earphone housing including the foldable sleeve with a first diametrical size, and in a second folded position, providing the earphone housing including the foldable sleeve with a second diametrical size. The second diametrical size may be larger than the first diametrical size.

21 Claims, 9 Drawing Sheets

SIZE ADJUSTABLE DEVICE AND METHOD

TECHNICAL FIELD

One or more embodiments disclosed herein may relate to an earphone. One or more embodiments may relate to an earphone housing, a portable hands free device including an earphone housing, or a method for an earphone housing. One or more embodiments may relate to an earphone housing including a foldable sleeve, which earphone housing may be adjustable in size.

BACKGROUND

Portable electronic devices, such as cordless and cellular telephones, pagers, wireless modems, wireless email devices, personal digital assistants (PDAs) with communication functions, MP3 players, and other portable electronic devices are becoming increasingly commonplace. Some of these portable electronic devices may be configured to communicate with other devices over a wireless communications network. Users of these portable electronic devices may take these devices with them anywhere they go, which may allow these users to, for example, place phone calls, listen to music, check an appointment on a calendar, check email, and/or access the Internet and the information available thereon using the portable electronic device.

The user may hold the portable electronic device with at least one hand, which may limit the operability and general agility performance of the user. The user may use earphones, e.g., with an attached microphone, which may help alleviate the limitations of holding the device. The portable electronic device may accordingly be carried, e.g., in a pocket with, thus potentially liberating the user's hand and allowing him/her to move his/her arms in any possible direction while using the portable electronic device. However, the size of users' ears may vary between different users of portable hands free devices adapted to be attached to a portable electronic device, such as earphones. As an example, a young girl may have considerably smaller ears than an old man. This difference in ear size may be a concern with respect to the concha of the ear, and may result in a problem for a user to fit earphones into his/her ear. A medium size earphone may be too big for some users, and too small for other users, including users having non-extreme ear sizes, which may cause inconvenience.

A possible solution to this problem may be to produce earphones in different sizes. However, such solution may be costly compared with producing earphones in just one size, and thus may be undesired for this reason.

Another possible solution may be to attach separate foam rubber adapters of different sizes to the earphones. In that way, the user may adapt his/her earphones to his/hers ear size to achieve a better fit. However, it may be undesirable to have loose spare parts adapted to the earphone, as these may get lost, which may render annoyance or frustration to the user.

Yet another possible solution may be to fixate the earphones to the ear by using a metal frame or the like, worn over the users head. This may, however, be undesirable because it may disturb the aesthetic impression of the user's hairstyle, may be uncomfortable, and/or impossible to wear under, e.g., a hat and may be generally annoying or inconvenient for the user.

Yet another possible solution in order to meet this problem may be to fixate the earphones with clips, or the like, to the user's earlobe. Such a solution may, however, cause pain to the sensitive user and may thus cause a general inconvenience. Such a solution may also cause hesitation in particular among conservative male users; as it may give associations to ear rings and body piercing.

SUMMARY

A first aspect of one or more embodiments may be directed towards a size adjustable earphone housing. The earphone housing may include a foldable sleeve, attached to the earphone housing. The foldable sleeve may include a first end and an opposite second end. The first end of the foldable sleeve may embrace the earphone housing. The opposite second end of the foldable sleeve may be adapted to be folded. The foldable sleeve may be adapted to be kept in a first unfolded position providing the earphone housing with a first diametrical size. The foldable sleeve may be further adapted to be kept in a folded position providing the earphone housing with a second diametrical size. The second diametrical size may be larger than first diametrical size. An embodiment of the first aspect may include the features of the first aspect, where the earphone housing may include friction enhancing means. The friction enhancing means may be adapted to enhance the friction between the earphone housing and the foldable sleeve.

One or more embodiments may include the features of the first aspect, where the friction enhancing means may include an external rib protruding from the outer surface of the earphone housing.

One or more embodiments may include the features of the first aspect, where the friction enhancing means may include an external incision in the outer surface of the earphone housing.

One or more embodiments may include the features of the first aspect, where the friction enhancing means may include an adhesive substance applied in the boundary layer between the earphone housing and the foldable sleeve.

One or more embodiments may include the features of the first aspect, where the foldable sleeve may be applied as a coating over the earphone housing. Thus, the foldable sleeve acts as a protective outer material of the earphone housing when the earphone housing is kept in a first unfolded position. When the earphone housing is kept in the first unfolded position, it provides the earphone housing with a first diametrical size.

One or more embodiments may include the features of the first aspect, where the difference between the first diametrical size and the second diametrical size may be approximately 1 millimeter in diameter.

One or more embodiments may include the features of the first aspect, where the diameter of the first diametrical size of the earphone housing may be approximately between 3 and 30 millimeters.

One or more embodiments may include the features of the first aspect, where the foldable sleeve may be made out of an elastic material, such as rubber, plastic or silicone.

One or more embodiments may include the features of the first aspect, where the foldable sleeve may be adapted to be rolled into a second folded position, providing the earphone housing with a second diametrical size.

One or more embodiments may include the features of the first aspect, where the foldable sleeve may be adapted to be folded with the second end of the foldable sleeve on top of the first end of the foldable sleeve, when the foldable sleeve is kept in a second folded position, providing the earphone housing with a second diametrical size.

One or more embodiments may include the features of the first aspect, where the foldable sleeve may be adapted to be folded with the first end of the foldable sleeve on top of the second end of the foldable sleeve, when the foldable sleeve is kept in a second folded position, providing the earphone housing with a second diametrical size.

A second aspect of one or more embodiments may be directed towards a portable hands free device including a size adjustable earphone housing, which may include the features of the first aspect.

A third aspect of one or more embodiments may be directed towards a method for adjusting the diametrical size of an earphone housing. The earphone housing may include a foldable sleeve. The foldable sleeve has a first end which may be attached to the earphone housing. The opposite second end of the foldable sleeve may be adapted to be folded. The method may include folding the second end of the foldable sleeve backwards, towards the first end of the foldable sleeve. Thus, the earphone housing may be provided with a second diametrical size.

One or more embodiments may include the features of the third aspect, and further may include pulling out the foldable sleeve from the earphone housing. The foldable sleeve may be pulled out a distance approximately half as long as the length of the foldable sleeve.

One or more embodiments may include the features of the third aspect, and further may include tucking in the second end of the foldable sleeve under the first end of the foldable sleeve, situating the second end of the foldable sleeve under the first end of the foldable sleeve. The earphone housing may thus be provided with a second diametrical size.

One or more embodiments may include the features of the third aspect, and further may include folding over the second end of the foldable sleeve over the first end of the foldable sleeve, situating the second end of the foldable sleeve over the first end of the foldable sleeve. The earphone housing may thus be provided with a second diametrical size.

BRIEF DESCRIPTION OF THE DRAWINGS

The present invention will now be described more in detail in relation to the enclosed drawings, in which.

DETAILED DESCRIPTION OF PREFERRED EMBODIMENTS

Embodiments disclosed herein may provide a size adjustable earphone housing, a portable hands free device including an earphone housing, and a method for adjusting an earphone housing in size, which may be put into practice in the embodiments described below. This invention may, however, be embodied in many different forms and should not be construed as limited to the embodiments set forth herein; rather, these embodiments are provided so that this disclosure will be thorough and complete, and will fully convey the scope of the invention to those skilled in the art. It should be understood that there is no intent to limit the present size adjustable earphone housing, portable hands free device including an earphone housing and/or method for adjusting an earphone housing in size to any of the particular forms disclosed, but on the contrary, the present size adjustable earphone housing, portable hands free device including an earphone housing and method for adjusting an earphone housing in size is to cover all modifications, equivalents, and alternatives falling within the scope of the invention as defined by the claims.

Embodiments disclosed herein may facilitate facilitating the fit of an earphone in the ear of a user, such as when the user uses a portable hands free device. In addition, embodiments disclosed herein may provide new functions and features.

In one embodiment, a foldable sleeve of the present size adjustable earphone housing, portable hands free device including a size adjustable earphone housing, or method for adjusting the size of an earphone housing, may allow for the change in the diameter size of an earphone housing from a first diametrical size to a second larger diametrical size by folding the foldable sleeve, without, for example, attaching additional loose parts, such as, e.g., soft pads to the earphone housing. Thereby, it may be possible to reduce the risk of loosing or mislaying any such additional loose parts. Thus, one or more embodiments disclosed herein may provide for an improved earphone housing. Also, one or more embodiments may provide for ergonomic improvements to the user, which may also result in cost savings for the manufacturer of a size adjustable earphone housing and/or portable hands free device including a size adjustable earphone housing. As the present size adjustable earphone housing may fit a large group of users, the wearing consistency may be improved. In one or more embodiment, sound leakage may be avoided, and the sound level may be lowered without loosing sound quality. Thus, the risk of hearing damages e.g., tinnitus may be reduced, and lower volume also results in less power consumption, which may save energy resources.

Figure 1:
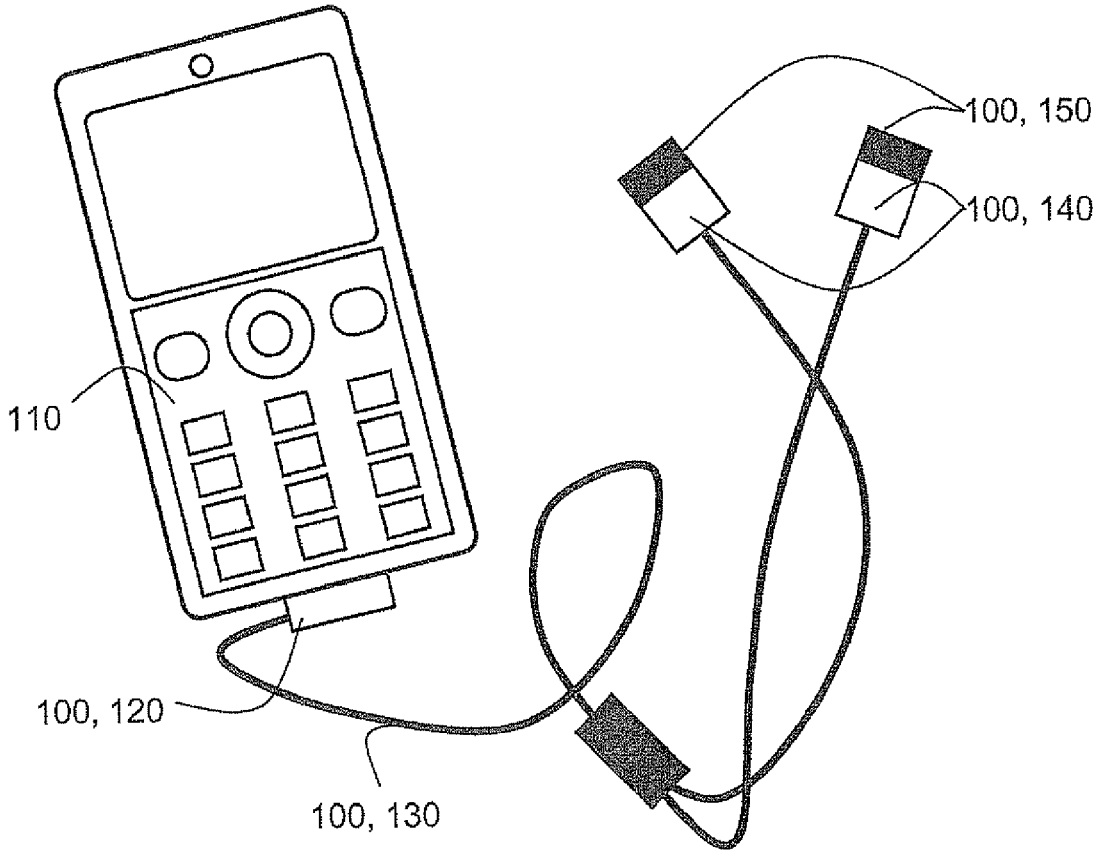
FIG. 1 is an exemplary schematic block diagram illustrating a portable electronic device with an attached portable hands free device including an earphone housing.

FIG. 1 is a schematic illustration of an exemplary portable hands free device 100 attached to a portable electronic device 110. The portable hands free device 100 may be attached to the portable electronic device 110 via a port 120. The port 120 may be linked with a cable connection 130 to at least one size adjustable earphone housing 140. According to some embodiments, the port 120 may be linked with a cable connection 130 to two size adjustable earphone housings 140; one earphone housing 140 may be adapted to be situated into each ear of a user. On one or more of the size adjustable earphone housings 140 may be a foldable sleeve 150 attached.

The portable electronic device 110 as herein described may, in some embodiments, include a portable electronic device, such as a mobile station, e.g., a mobile cellular radiotelephone. However, as used herein, a "portable electronic device" may include devices having only a wireless signal receiver without transmit abilities and devices having both receive and transmit hardware capable of two-way communication over a two-way communication link as well as devices without any communication ability at all. The portable electronic device 110 may, according to some embodiments, be somewhat not so very portable and may include, e.g., a stationary computer. The portable electronic device 110 may, according to some embodiments, be a Personal Digital Assistant (PDA), an MP3 player, a laptop, a digital camera, a digital video camera or any other kind of portable electronic device, such as a notebook computer, walkie-talkie, hunting radio, baby monitor etc. The portable electronic device 110 may, in some embodiments, be a foldable portable communication device.

The portable hands free device 100 may be an in-concha headset, adapted to be carried in the concha of the ear. However, according to some embodiments, the portable hands free device 100 may be an in-ear headset, adapted to be carried in the auditory meatus of the ear.

Figure 2A:
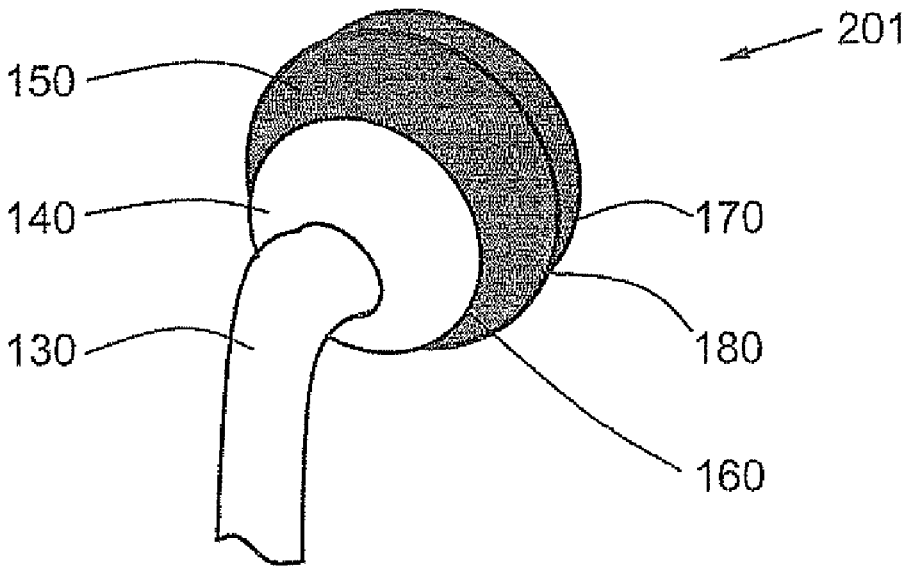
FIG. 2A is a three dimensional view depicting an embodiment of an exemplary earphone housing with a foldable sleeve in an unfolded position.

FIG. 2A schematically depicts an embodiment of an exemplary earphone housing 140 with a foldable sleeve 150 in a first unfolded position 201. The foldable sleeve 150 may include a first end 160 and an opposite, second end 170. The first end 160 of the foldable sleeve 150 embraces the earphone housing 140. Further, the foldable sleeve 150 may be attached to the earphone housing 140. The attachment may be realized, e.g., by applying friction enhancing means between the earphone housing 140 and at least a part of the foldable sleeve 150, by using the elasticity of the material comprised within the foldable sleeve 150, by applying at least one external rib protruding from the surface of the earphone housing 140, by applying an external incision in the outer surface of the earphone housing 140, by applying a friction enhancing external coating over the earphone housing 140, by creating a friction enhanced zone on the external surface of the earphone housing 140 by scratching the surface, by applying an adhesive substance, such as, e.g., glue, by applying an adhesive tape, or by using other convenient fixation means, such as, e.g., snapping, sticking, pinning, bolting, pinching, strapping, clipping, pegging, screwing, hooking, hinging, welding, stitching, melting, fastening, tacking, tying, cramping, velcroing, by using magnetism, or by a combination of a plurality of these and/or other attachment means, permanently or temporarily attaching at least a part of the foldable sleeve 150 to the earphone housing 140.

According to some embodiments, the first end 160 of the foldable sleeve 150 may be attached to the earphone housing 140.

According to some embodiments, the second end 170 of the foldable sleeve 150 may be attached to the earphone housing 140.

According to some embodiments, both the first end 160 of the foldable sleeve 150 and the second end 170 of the foldable sleeve 150 may be attached to the earphone housing 140.

The second end 170 of the foldable sleeve 150 may be situated opposite to the first end 160 of the foldable sleeve 150. The second end 170 of the foldable sleeve 150 may be further adapted to be folded.

When the foldable sleeve 150 is situated in the first unfolded position 201, the foldable sleeve 150 may be coating the earphone housing 140, e.g., applied as a coating to the earphone housing 140. Thus, the foldable sleeve 150 may be at least partly covering the exterior of the earphone housing 140 and may act as a protective outer material of the earphone housing 140. The outer surface of the earphone housing 140 may thereby be somewhat protected against scratches, dirt, dust, heat, radiation, cold, humidity, electro magnetic disturbance and may also reduce sound leakage to and/or from the earphone housing 140.

The earphone housing 140 may further, according to some embodiments, be attached to a cable connection 130.

Figure 2B:
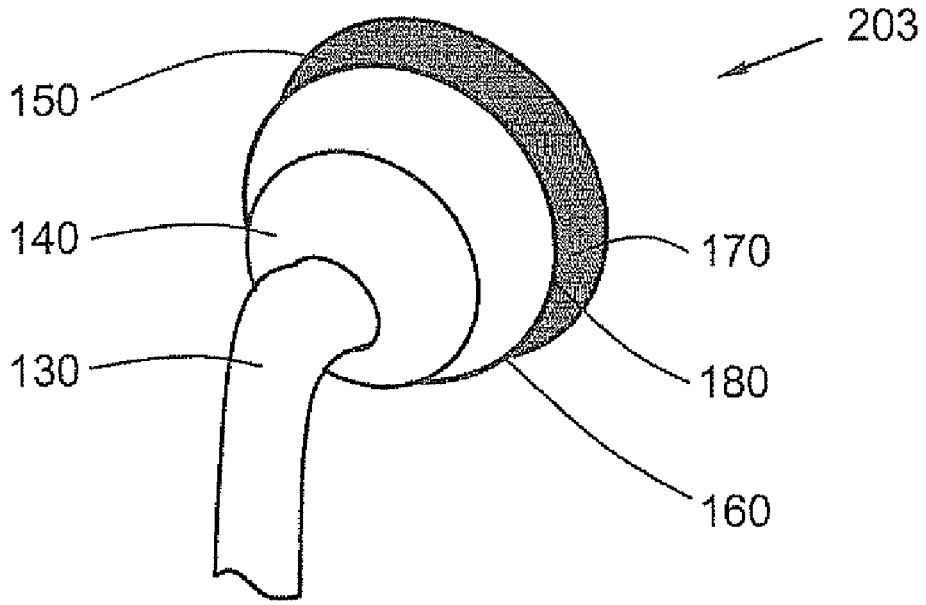
FIG. 2B is a three dimensional view depicting the embodiment of the exemplary earphone housing according to FIG. 2A with a foldable sleeve in an unfolded position.

FIG. 2B schematically depicts the embodiment of the earphone housing 140 with the foldable sleeve 150 in a folded position 203. The foldable sleeve 150 may be folded at least once, which may increase the diametrical size of the earphone housing 140 with the foldable sleeve 150. Thus, the earphone housing 140 with the foldable sleeve 150 in the folded position 203 as illustrated in FIG. 2B may fit a user with a bigger ear than the earphone housing 140 with the foldable sleeve 150 in the first unfolded position 201 as illustrated in FIG. 2A.

FIG. 2A and FIG. 2B thus schematically illustrate one embodiment of the a size adjustable earphone housing 140, where the size adjustment may be performed by folding a foldable sleeve 150. The folding procedure, transforming the earphone housing 140 with the foldable sleeve 150 from the first unfolded position 201 to the folded position 203 may be realized in a plurality of ways, as will be discussed, illustrated, and exemplified more in detail below.

Figure 3A:
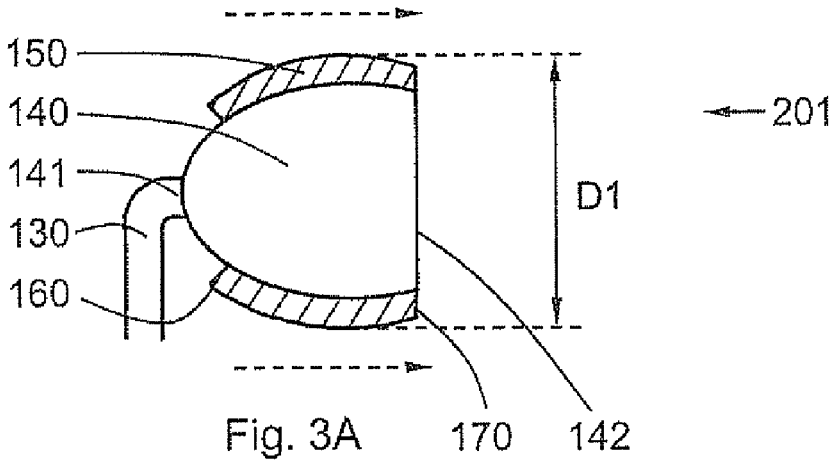
FIG. 3A is a cross section schematically depicting an embodiment of an exemplary earphone housing with a foldable sleeve in a first unfolded position.

FIG. 3A schematically depicts a cross section of an embodiment of the earphone housing 140, with the foldable sleeve 150 in the first unfolded position 201. The earphone housing 140 may include a first closed end 141 and a second open end 142, situated opposite to the first closed end 141. Sound waves may be emitted through the second open end 142 of the earphone housing 140. The foldable sleeve 150 may include a first end 160 and an opposite, second end 170.

The foldable sleeve 150 may be attached to any earphone housing 140 with an appropriately designed interior. As the internal design of the earphone housing 140 may be irrelevant for the functionality of the present device and method, and in order to simplify the understanding of the present device and method, some details of the interior of the earphone housing 140 are omitted in FIGS. 3A-8C.

According to some embodiments, the second end 170 of the foldable sleeve 150 may be situated in the proximity of the second open end 142 of the earphone housing 140 when the foldable sleeve 150 is situated in the first unfolded position 201. Further, according to these embodiments, the foldable sleeve 150 may be placed on the outside of the earphone housing 140, embracing the earphone housing 140 and stretching itself towards the first closed end 141 of the earphone housing 140, such that the first end 160 of the foldable sleeve 150 may be situated closer to the first closed end 141 of the earphone housing 140 than the second end 170 of the foldable sleeve 150.

However, according to some other embodiments the situation may be the opposite, such that the first end 160 of the foldable sleeve 150 may be situated in the proximity of the second open end 142 of the earphone housing 140 when the foldable sleeve 150 is situated in the first unfolded position 201. Further, according to these embodiments, the foldable sleeve 150 may be placed on the outside of the earphone housing 140, embracing the earphone housing 140 and stretching itself towards the first closed end 141 of the earphone housing 140, such that the second end 170 of the foldable sleeve 150 may be situated closer to the first closed end 141 of the earphone housing 140 than the first end 160 of the foldable sleeve 150.

The earphone housing 140 may be attached to the cable connection 130, which in turn may be attached to the portable electronic device 110.

Further, when the earphone housing 140 with the foldable sleeve 150 is kept in the first unfolded position 201, the earphone housing 140 with the foldable sleeve 150 may be provided with a first diametrical size D1. The second open end 142 of the earphone housing 140 may be, e.g., circular according to some embodiments. However, the second open end 142 of the earphone housing 140 may as well, according to some embodiments, be oval, elliptical, egg-shaped, semi-circular, hexagonal, octagonal, pentagonal, or shaped in any other suitable shape, such as, e.g., being amorphous.

The diametrical size D1 of the second open end 142 of the earphone housing 140 with the foldable sleeve 150 kept in the first unfolded position 201 may be, as a non limiting example only, between 3 and 30 millimeters. According to some embodiments, the diametrical size D1 in the first unfolded position 201 may be between, e.g., 5 and 20 millimeters. According to yet some embodiments, the diametrical size D1 in the first lo unfolded position 201 may be e.g. approximately 8 millimeters, 10 millimeters, 12 millimeters, 15 millimeters or 17 millimeters. The diametrical size D1 in the first unfolded position 201 being approximately 15 millimeter+/−5 millimeters may allow for a large part of the population to be comfortable with that that particular diametrical size D1 when the earphone housing 140 is carried in-concha. However, when the earphone housing 140 is used in an in-ear headset type of portable hands free device 100, adapted to be carried in the auditory meatus of the ear, one embodiment may allow for the diametrical size D1 in the first unfolded position 201 be approximately 7 millimeters+/−3 millimeters.

Figure 3B:
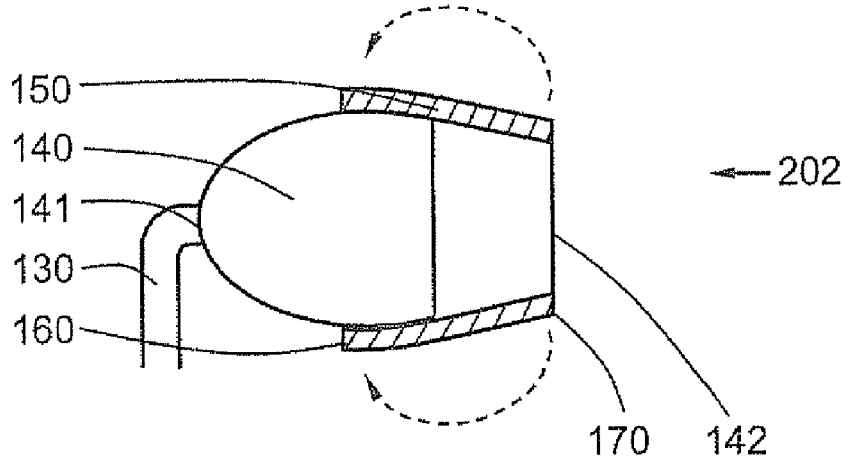
FIG. 3B is a cross section schematically depicting the embodiment of the exemplary earphone housing according to FIG. 3A, with the foldable sleeve in a second unfolded position.

FIG. 3B schematically depicts a cross section of the embodiment of the earphone housing 140 with the foldable sleeve 150 as depicted in FIG. 3A, but arranged in a second unfolded position 202, just before the folding of the foldable sleeve 150. The foldable sleeve 150 may be partly pulled out from the earphone housing 140 in the direction of the second open end 142 of the earphone housing 140, as indicated by the dashed arrows in FIG. 3A. Thus, the second end 170 of the foldable sleeve 150 has been pulled over the second open end 142 of the earphone housing 140. However, the first end 160 of the foldable sleeve 150 may still embrace the earphone housing 140.

The second unfolded position 202 as illustrated in FIG. 3B may be an intermediary form which, according to some embodiments, may be applied in order to simplify the conversion of the size adjustable earphone housing 140 with an attached foldable sleeve 150, from the first unfolded position 201 into the folded position 203. In one embodiment, the second unfolded position 202 may not be an intermediary form if, for example, the user of the portable communications device 110 desires the second unfolded position 202.

Figure 3C:
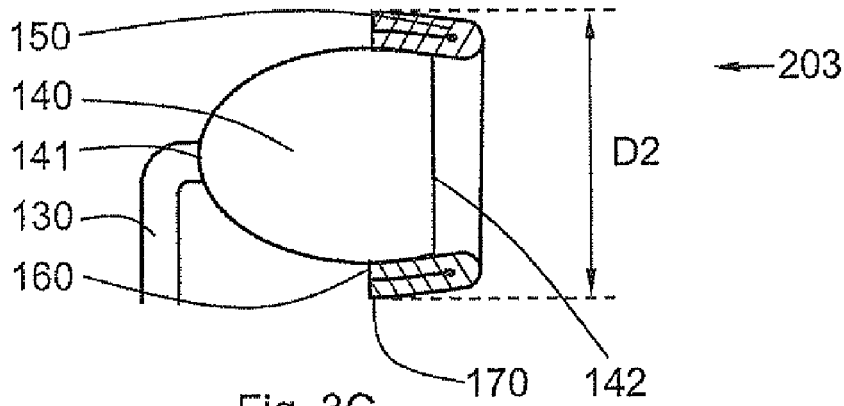
FIG. 3C is a cross section schematically depicting the embodiment of the exemplary earphone housing according to FIG. 3A, with the foldable sleeve in a folded position.

FIG. 3C schematically depicts a cross section of an embodiment of the earphone housing 140 depicted in FIGS. 3A and 3B, with the foldable sleeve 150 in the folded position 203. The second end 170 of the foldable sleeve 150 has been folded outwards, over the first end 160 of the foldable sleeve 150, such that the second end 170 of the foldable sleeve 150 may be situated above the first end 160 of the foldable sleeve 150, as indicated by the dashed arrows in FIG. 3B. The earphone housing 140, with the foldable sleeve 150 in the folded position 203 thus may create a diametrical size D2. The diametrical size D2 may be larger than the diametrical size D1, which may be obtained when the foldable sleeve 150 is situated in the first unfolded position 201, as illustrated in FIG. 3A.

The diametrical size D2 of the earphone housing 140 with the foldable sleeve 150 may be increased approximately two times the thickness of the foldable sleeve 150, when positioned in the folded position 203, in comparison with the diametrical size D1 of the earphone housing 140 with the foldable sleeve 150 in the first unfolded position 201.

Thus, as an example, if the diametrical size D1 of the earphone housing 140 with the foldable sleeve 150 in the first unfolded position 201 is 15 millimeters and the thickness of the foldable sleeve 150 is 0.5 millimeters, the resulting second diametrical size D2 when the earphone housing 140 with the foldable sleeve 150 is folded into the folded position 203 may be 16 millimeters. These dimensions are mentioned as non limiting examples only, in order to simplify the reader's understanding of the present method and device. In another example, the diametrical size D1 of the earphone housing 140 with the foldable sleeve 150 in the first unfolded position 201 may be 7 millimeters and the thickness of the foldable sleeve 150 may be 1 millimeter. The resulting second diametrical size D2 when the earphone housing 140 with the foldable sleeve 150 is folded into the folded position 203 then becomes 9 millimeters.

One embodiment may allow the diametrical size D2 of the foldable sleeve 150 when folded into the folded position 203 be 16 millimeter+/−5 millimeters. In this embodiment, a large part of the intended user group may find the diametrical size D2 comfortable when the earphone housing 140 is carried in-concha. When the earphone housing 140 is carried in-ear, in the auditory meatus of the ear, one embodiment may allow the diametrical size D2 in the folded position 203 be approximately 8 millimeters+/−3 millimeters. The foldable sleeve 150 may be made out of an elastic material, such as an arbitrary elastomer, e.g., rubber, plastic or silicone.

Some non limiting examples of such elastic material may be e.g.: Polyurethane rubber, Nitrile Rubber Butyl rubber, Silicone rubber, Chloro Butyl Rubber, Bromo Butyl Rubber, Polybutadiene, Styrene-butadiene Rubber, Halogenated butyl rubbers, Hydrogenated Nitrile Rubbers, Chloroprene Rubber, Perfluoroelastomers, Neoprene, Baypren, ethylene propylene rubber, Epichlorohydrin rubber, Polyacrylic rubber, Synthetic Polyisoprene, Fluorosilicone Rubber, Fluoroelastomers, Polyether Block Amides, the proteins resilin and/or elastin, Ethylene-vinyl acetate, Thermoplastic Elastomers, Thermoplastic Vulcanizates, Chlorosulfonated Polyethylene, Polychloroprene, Polysulfide Rubber, etc.

Figure 4A:
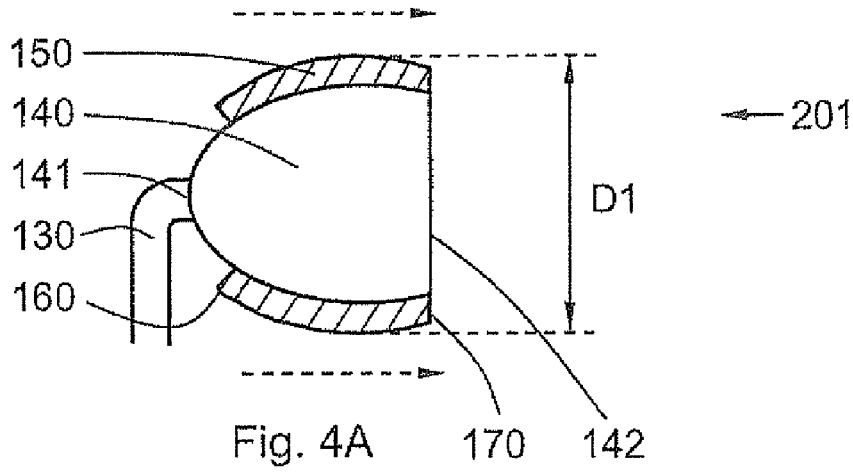
FIG. 4A is a cross section schematically depicting an embodiment of an exemplary earphone housing, with a foldable sleeve in a first unfolded position.

FIG. 4A schematically depicts a cross section of another embodiment of the earphone housing 140, with the foldable sleeve 150 in the first unfolded position 201. The embodiment depicted in FIG. 4A somewhat resembles the embodiment already depicted in FIG. 3A.

The earphone housing 140 may include the first closed end 141 and the second open end 142, situated opposite to the first closed end 141. The foldable sleeve 150 may include the first end 160 and an opposite, second end 170. The earphone housing 140 may be attached to the cable connection 130, which in turn may be attached to the portable electronic device 110.

Further, when the earphone housing 140 with the foldable sleeve 150 is kept in the first unfolded position 201, the earphone housing 140 with the foldable sleeve 150 may be provided with a first diametrical size D1.

Figure 4B:
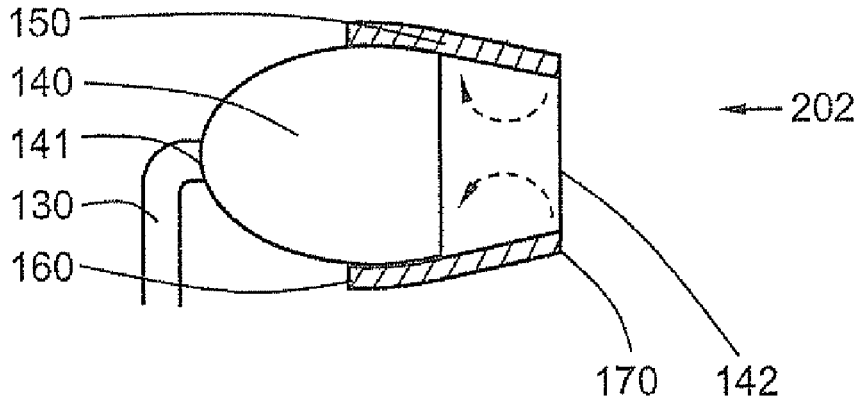
FIG. 4B is a cross section schematically depicting the embodiment of the earphone housing according to FIG. 4A, with the foldable sleeve in a second unfolded position.

FIG. 4B schematically depicts a cross section of the embodiment of the earphone housing 140, with the foldable sleeve 150 in a second unfolded position 202, as depicted in FIG. 4A, just before the folding of the foldable sleeve 150. The foldable sleeve 150 may be partly pulled out from the earphone housing 140 in the direction of the second open end 142 of the earphone housing 140, as indicated by the dashed arrows in FIG. 4A. Thus, the second end 170 of the foldable sleeve 150 may be pulled over the second open end 142 of the earphone housing 140. However, the first end 160 of the foldable sleeve 150 may still embrace the earphone housing 140. The embodiment depicted in FIG. 4B somewhat resembles the embodiment already depicted in FIG. 3B.

The second unfolded position 202 may be an intermediary form which, according to some embodiments, may be applied in order to simplify the conversion of the size adjustable earphone housing 140 with an attached foldable sleeve 150, from the first unfolded position 201 into the folded position 203. In one embodiment, unfolded position 202 may no be an intermediary position if, for example, the user of portable communications device 110 desires unfolded position 202.

Figure 4C:
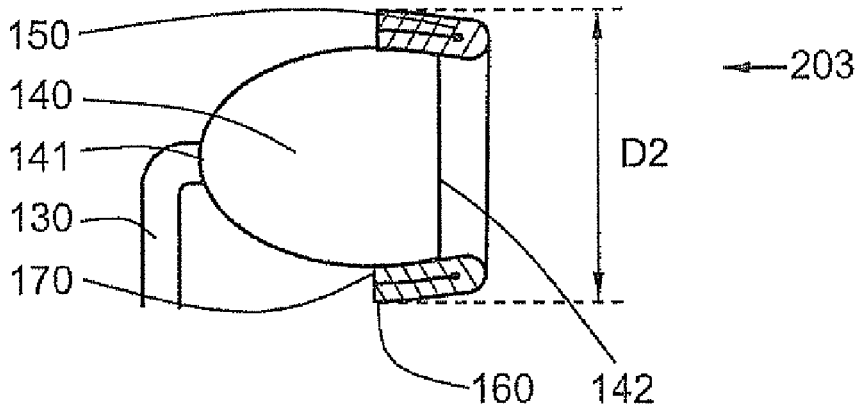
FIG. 4C is a cross section schematically depicting the embodiment of the exemplary earphone housing according to FIG. 4A, with the foldable sleeve in a folded position.

FIG. 4C schematically depicts a cross section of an embodiment of the earphone housing 140 depicted in FIGS. 4A and 4B, with the foldable sleeve 150 in the folded position 203. The second end 170 of the foldable sleeve 150 has been folded inwards, tucked under the first end 160 of the foldable sleeve 150, as indicated by the dashed arrows in FIG. 4B. Thus, the second end 170 of the foldable sleeve 150 may be situated under the first end 160 of the foldable sleeve 150. The earphone housing 140 with the foldable sleeve 150 in the folded position 203 thus may create a diametrical size D2. The diametrical size D2 may be larger than the diametrical size D1, which may be obtained when the foldable sleeve 150 is situated in the first unfolded position 201, as illustrated in FIG. 4A.

The diametrical size D2 of the earphone housing 140 with the foldable sleeve 150 may be increased with approximately two times the thickness of the foldable sleeve 150, when positioned in the folded position 203, in comparison with the diametrical size D1 of the earphone housing 140 with the foldable sleeve 150 in the first unfolded position 201.

The dimensions of the diametrical sizes D1, D2 of the earphone housing 140 with the foldable sleeve 150, as well as the material and dimensions of the foldable sleeve 150 of the embodiment according to FIGS. 4A, 4B, and 4C may be the same or similar as previously discussed under FIGS. 3A, 3B and 3C.

Figure 5A:
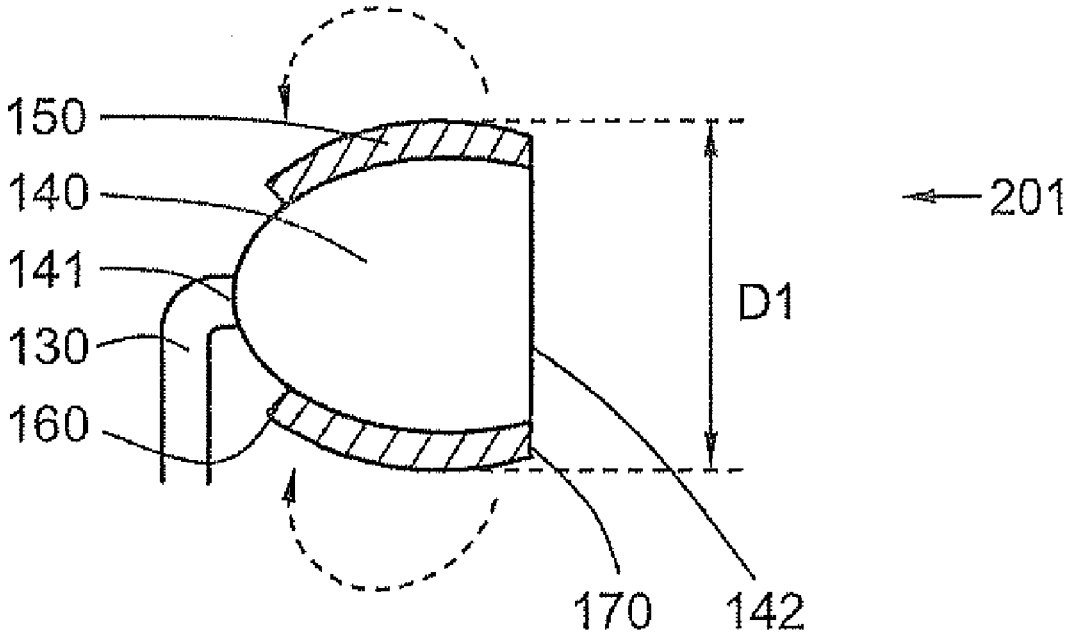
FIG. 5A is a cross section schematically depicting an embodiment of an exemplary earphone housing, with a foldable sleeve in a first unfolded position.

FIG. 5A schematically depicts a cross section of a third embodiment of the earphone housing 140, with the foldable sleeve 150 in the first unfolded position 201. The embodiment depicted in FIG. 5A somewhat resembles the embodiment already depicted in FIG. 3A and FIG. 4A.

The earphone housing 140 may include the first closed end 141 and the second open end 142, situated opposite to the first closed end 141. The foldable sleeve 150 may include the first end 160 and the opposite, second end 170. The earphone housing 140 may be attached to the cable connection 130, which in turn may be attached to the portable electronic device 110.

Further, when the earphone housing 140 with the foldable sleeve 150 is kept in the first unfolded position 201, the earphone housing 140 with the foldable sleeve 150 may be provided with the first diametrical size D1.

Figure 5B:
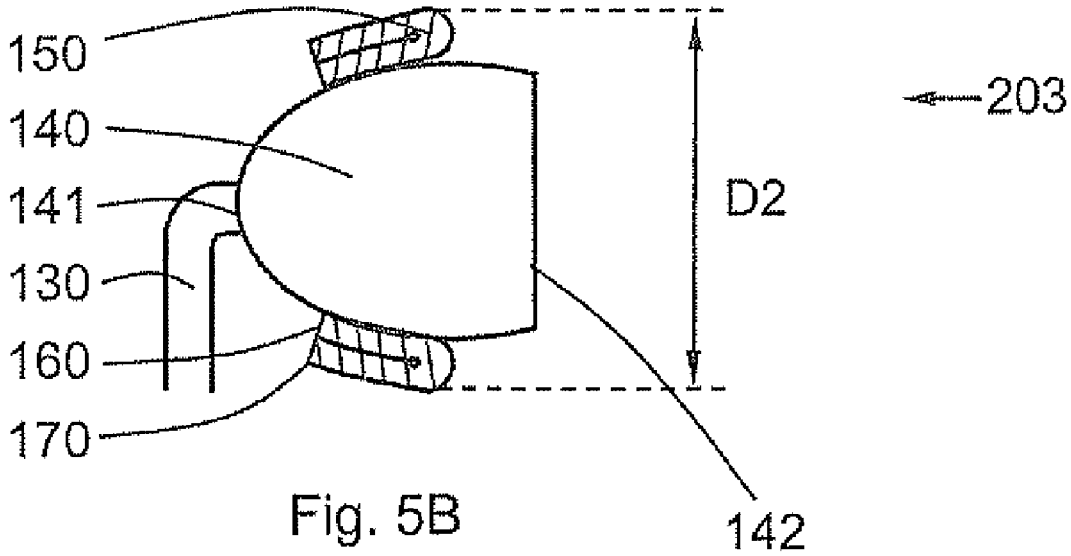
FIG. 5B is a cross section schematically depicting the embodiment of the exemplary earphone housing according to FIG. 5A, with the foldable sleeve in a folded position.

FIG. 5B schematically depicts a cross section of an embodiment of the earphone housing 140 depicted in FIG. 5A, with the foldable sleeve 150 in the folded position 203. The second end 170 of the foldable sleeve 150 has been folded outwards, over the first end 160 of the foldable sleeve 150, as indicated by the dashed arrows in FIG. 5A, such that the second end 170 of the foldable sleeve 150 may be situated over the first end 160 of the foldable sleeve 150. The earphone housing 140 with the foldable sleeve 150 in a folded position 203 thus may create a diametrical size D2. The diametrical size D2 may be larger than the diametrical size D1, which may be obtained when the foldable sleeve 150 is situated in the first unfolded position 201, as illustrated in FIG. 5A.

The diametrical size D2 of the earphone housing 140 with the foldable sleeve 150 may be increased with approximately two times the thickness of the foldable sleeve 150, when positioned in the folded position 203, in comparison with the diametrical size D1 of the earphone housing 140 with the foldable sleeve 150 in the first unfolded position 201.

The dimensions of the diametrical sizes D1 and D2 of the earphone housing 140 with the foldable sleeve 150, as well as the material and dimensions of the foldable sleeve 150 of the embodiment according to FIGS. 5A and 5B may be the same or similar as previously discussed under FIGS. 3A, 3B and 3C.

According to the embodiment illustrated in FIG. 5A and FIG. 5B, the conversion from diametrical size D1 in the first unfolded position 201 of the earphone housing 140 to the diametrical size D2 in the folded position 203 of the earphone housing 140 is performed without any intermediate second unfolded position 202. This embodiment may allow the user to simplify the conversion process from the first unfolded position 201 to the folded position 203, and may allow the user to perform the conversion process with a reduced risk of loosing the foldable sleeve 150, e.g., by unintentionally sliding off the earphone housing 140.

Figure 6A:
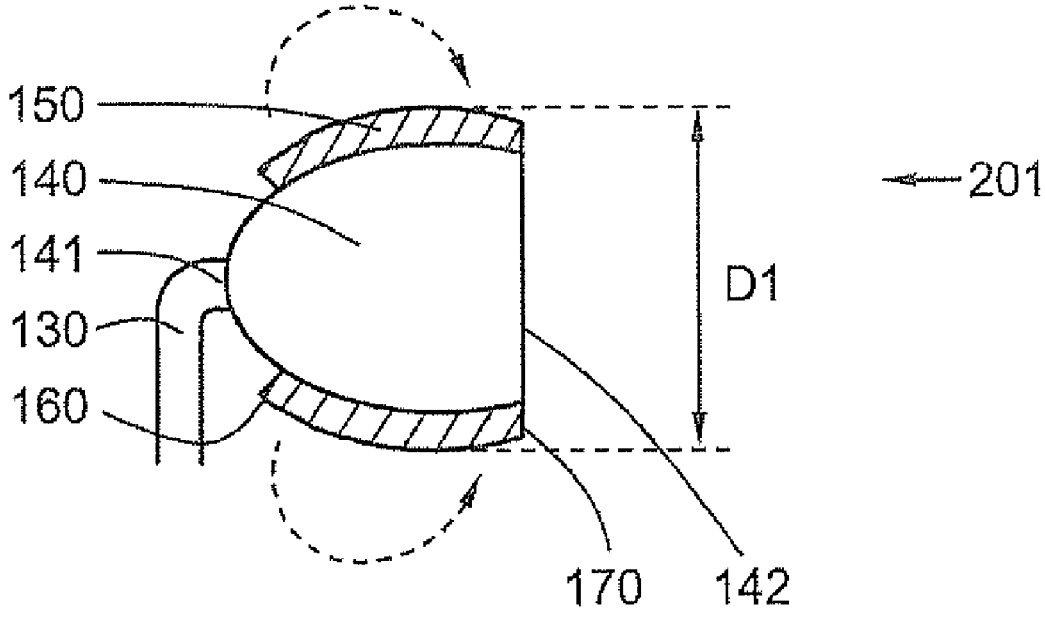
FIG. 6A is a cross section schematically depicting an embodiment of an exemplary earphone housing, with a foldable sleeve in a first unfolded position.

FIG. 6A schematically depicts a cross section of a fourth embodiment of the earphone housing 140, with the foldable sleeve 150 in the first unfolded position 201. The embodiment depicted in FIG. 6A somewhat resembles the embodiment already depicted in FIG. 3A, FIG. 4A and FIG. 5A.

The earphone housing 140 may include the first closed end 141 and the second open end 142, situated opposite to the first closed end 141. The foldable sleeve 150 may include the first end 160 and an opposite, second end 170. The earphone housing 140 may be attached to the cable connection 130, which in turn may be attached to the portable electronic device 110.

Further, when the earphone housing 140 with the foldable sleeve 150 is kept in the first unfolded position 201, the earphone housing 140 with the foldable sleeve 150 may be provided with the first diametrical size D1.

Figure 6B:
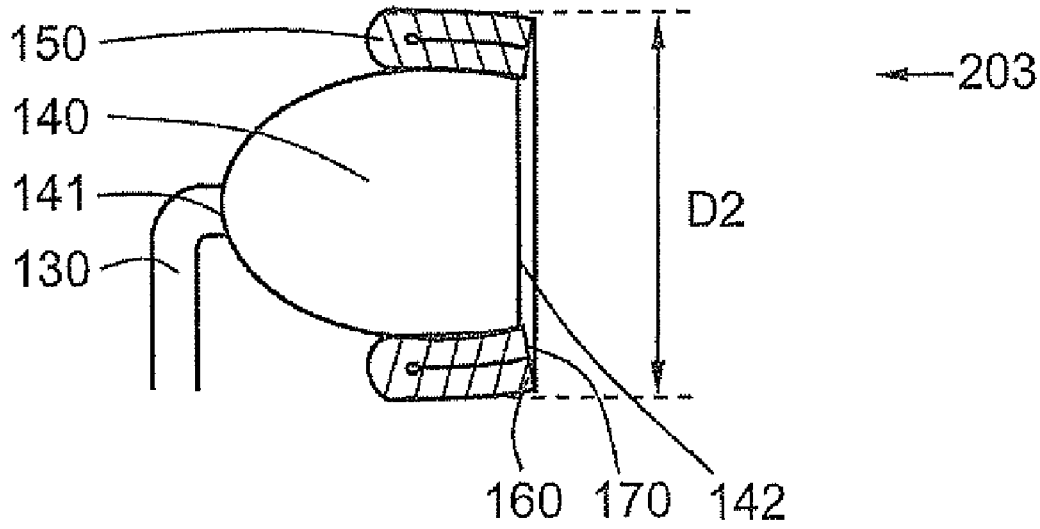
FIG. 6B is a cross section schematically depicting the embodiment of the exemplary earphone housing according to FIG. 6A, with the foldable sleeve in a folded position.

FIG. 6B schematically depicts a cross section of an embodiment of the earphone housing 140 depicted in FIG. 6A, with the foldable sleeve 150 in the folded position 203. The first end 160 of the foldable sleeve 150 has been folded outwards, towards the second open end 142 of the earphone housing 140, as indicated by the dashed arrows in FIG. 6A. Thus, the first end 160 of the foldable sleeve 150 may be folded over the second end 170 of the foldable sleeve 150, such that the first end 160 of the foldable sleeve 150 may be situated over the second end 170 of the foldable sleeve 150. The earphone housing 140 with the foldable sleeve 150 in the folded position 203 thus creates a diametrical size D2. The diametrical size D2 may be larger than the diametrical size D1, which may be obtained when the foldable sleeve 150 is situated in the first unfolded position 201, as illustrated in FIG. 6A.

The resulting diametrical size D2 of the earphone housing 140 with the foldable sleeve 150 may be increased with approximately two times the thickness of the foldable sleeve 150, when positioned in the folded position 203 in comparison with the diametrical size D2 of the earphone housing 140 with the foldable sleeve 150 in the first unfolded position 201.

The dimensions of the diametrical sizes D1 and D2 of the earphone housing 140 with the foldable sleeve 150, as well as the material and dimensions of the foldable sleeve 150 of the embodiment according to FIGS. 6A and 6B may be the same or similar as previously discussed under FIGS. 3A, 3B, and 3C.

According to the embodiment illustrated in FIG. 6A and FIG. 6B, the conversion from diametrical size D1 in the first unfolded position 201 of the earphone housing 140 to the diametrical size D2 in the folded position 203 of the earphone housing 140 may be performed without any intermediate second unfolded position 202 as earlier described in FIGS. 3B, 4B and 5B. This embodiment may provide the user to simplify the conversion process from the first unfolded position 201 to the folded position 203 and may reduce the risk of loosing the foldable sleeve 150 e.g. by unintentionally sliding of the earphone housing 140.

Figure 7A:
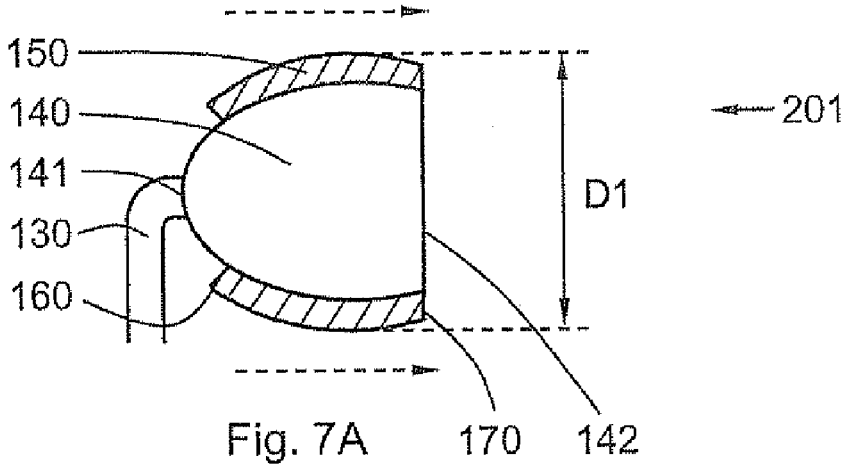
FIG. 7A is a cross section schematically depicting an embodiment of an exemplary earphone housing, with a foldable sleeve in a first unfolded position.

FIG. 7A schematically depicts a cross section of a fifth embodiment of the earphone housing 140, with the foldable sleeve 150 in the first unfolded position 201. The embodiment depicted in FIG. 7A somewhat resembles the embodiment already depicted in FIG. 3A, FIG. 4A, FIG. 5A and FIG. 6A.

The earphone housing 140 may include the first closed end 141 and the second open end 142, situated opposite to the first closed end 141. The foldable sleeve 150 may include the first end 160 and the opposite, second end 170. The earphone housing 140 may be attached to the cable connection 130, which in turn may be attached to the portable electronic device 110.

Further, when the earphone housing 140 with the foldable sleeve 150 is kept in the first unfolded position 201, the earphone housing 140 with the foldable sleeve 150 may be provided with the first diametrical size D1.

The diametrical size D1 of the second open end 142 of the earphone housing 140 with the foldable sleeve 150 kept in the first unfolded position 201 may be, as a non limiting example only, between 3 and 30 millimeters. According to some embodiments, the diametrical size D1 in the first unfolded position 201 may be between e.g. 5 and 20 millimeters. According to yet some embodiments, the diametrical size D1 in the first unfolded position 201 may be, e.g., approximately 8 millimeters, 10 millimeters, 12 millimeters, 15 millimeters or 17 millimeters.

One embodiment provides the diametrical size D1 in the first unfolded position 201 to be approximately 15 millimeters+/−5 millimeters, which may allow a large part of the population to be comfortable with that particular diametrical size D1 when the earphone housing 140 is carried in-concha. However, when the earphone housing 140 is used in an in-ear headset type of portable hands free device 100, adapted to be carried in the auditory meatus of the ear, one embodiment may provide the diametrical size D1 in the first unfolded position 201 to be approximately 7 millimeters+/−3 millimeters.

Figure 7B:
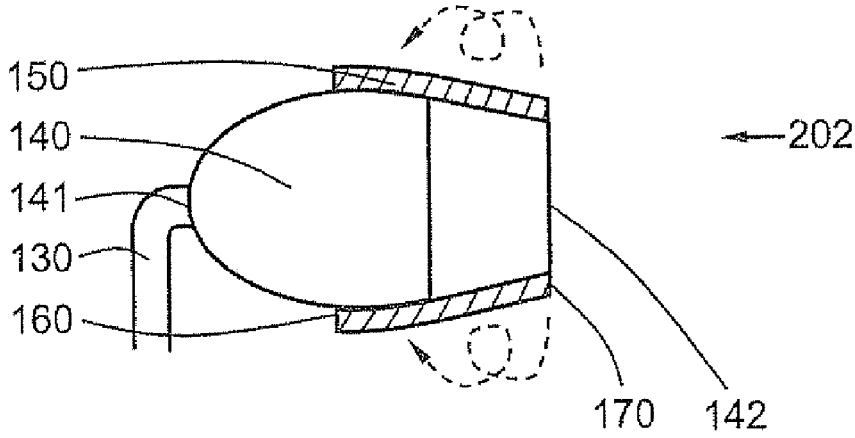
FIG. 7B is a cross section schematically depicting the embodiment of the exemplary earphone housing according to FIG. 7A, with the foldable sleeve in a second unfolded position.

FIG. 7B schematically depicts a cross section of the embodiment of the earphone housing 140 as depicted in FIG. 7A, with the foldable sleeve 150 in the second unfolded position 202, just before the folding of the foldable sleeve 150. The foldable sleeve 150 may be partly pulled out from the earphone housing 140 in the direction of the second open end 142 of the earphone housing 140, as indicated by the dashed arrows in FIG. 7A. Thus, the second end 170 of the foldable sleeve 150 may be pulled over the second open end 142 of the earphone housing 140. However, the first end 160 of the foldable sleeve 150 may still embrace the earphone housing 140. The embodiment depicted in FIG. 7B somewhat resembles the embodiment already depicted in FIG. 3B and FIG. 4B.

The second unfolded position 202 may be an intermediary form which, according to some embodiments, may be applied in order to simplify the conversion of the size adjustable earphone housing 140 with an attached foldable sleeve 150, from the first unfolded position 201 into the folded position 203. In one embodiment, unfolded position 202 is not an intermediary form if the user of portable communications device 110 prefers unfolded position 202.

Figure 7C:
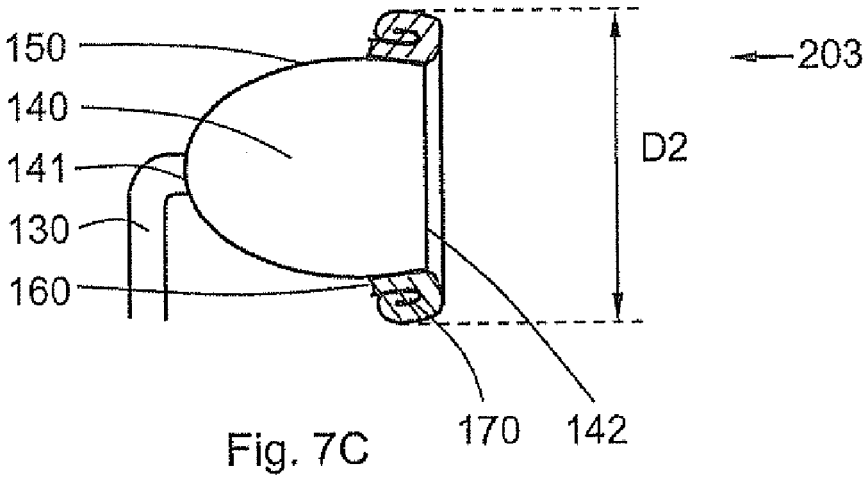
FIG. 7C is a cross section schematically depicting the embodiment of the exemplary earphone housing according to FIG. 7A, with the foldable sleeve in a folded position.

FIG. 7C schematically depicts a cross section of an embodiment of the earphone housing 140 depicted in FIG. 7A and FIG. 7B, with the foldable sleeve 150 in the folded position 203. The second end 170 of the foldable sleeve 150 has been rolled backwards, towards the closed end 141 of the earphone housing 140. Thus, the second end 170 of the foldable sleeve 150 may be rolled on the outside of the foldable sleeve 150, as indicated by the dashed arrows in FIG. 7B, such that the second end 170 of the foldable sleeve 150 may be situated over, but not adjacent to, the first end 160 of the foldable sleeve 150. The earphone housing 140 with the foldable sleeve 150 in a folded position 203 thus may create a diametrical size D2. The diametrical size D2 may be larger than the diametrical size D1, which may be obtained when the foldable sleeve 150 may be situated in the first unfolded position 201, as illustrated in FIG. 7A.

The resulting diametrical size D2 of the earphone housing 140 with the foldable sleeve 150 may be increased with approximately three-four times the thickness of the foldable sleeve 150, when the foldable sleeve 150 is positioned in the folded position 203. However, this difference in diametrical size between D1 and D2 may depend on the number of rotations and the amount of air included within the rolled foldable sleeve 150 in the folded position 203, and may thus vary considerably.

Thus, as an example, if the diametrical size D1 of the earphone housing 140 with the foldable sleeve 150 in the first unfolded position 201 is 15 millimeters and the thickness of the foldable sleeve 150 is 0.5 millimeters, the resulting second diametrical size D2 when the earphone housing 140 with the foldable sleeve 150 is rolled into the folded position 203 may be 17 millimeters. These figures are mentioned just as non limiting examples only, in order to simplify the less initiated readers understanding of the present method and device. In another example, the diametrical size D1 of the earphone housing 140 with the foldable sleeve 150 in the first unfolded position 201 may be 7 millimeters and the thickness of the foldable sleeve 150 may be 1 millimeter. The resulting second diametrical size D2 when the earphone housing 140 with the foldable sleeve 150 is rolled into the folded position 203 then become 11 millimeters.

One embodiment may provide the diametrical size D2 of the foldable sleeve 150 when folded into the folded position 203 to be 17 millimeter+/−5 millimeters, which a large part of the intended user group may find comfortable when the earphone housing 140 is carried in-concha. When the earphone housing 140 is carried in-ear, e.g., in the auditory meatus of the ear, one embodiment may provide the diametrical size D2 in the folded position 203 to be approximately 11 millimeters+/−3 millimeters.

Figure 8A:
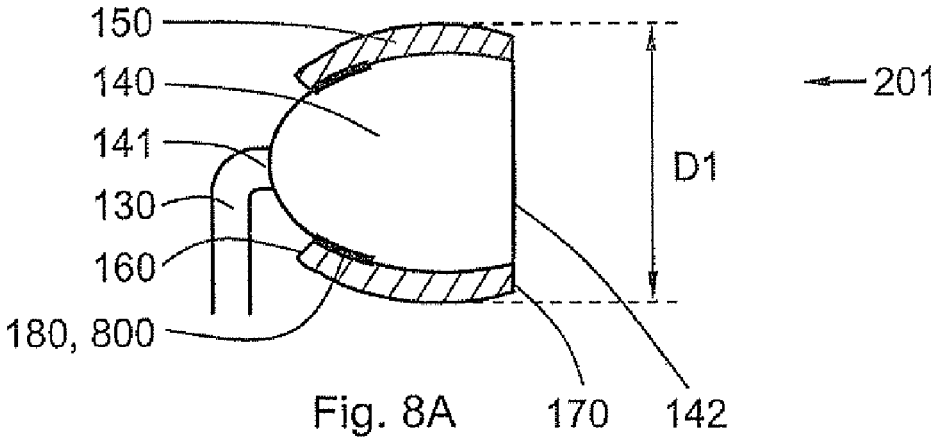
FIG. 8A is a cross section schematically depicting an embodiment of an exemplary earphone housing, with a foldable sleeve in a first unfolded position and an embodiment of friction enhancing means.

FIG. 8A schematically depicts a cross section of yet an embodiment of the earphone housing 140 with the foldable sleeve 150 in the first unfolded position 201 and an embodiment of friction enhancing means 180.

The earphone housing 140 may, according to some embodiments, be provided with friction enhancing means 180, preventing the foldable sleeve 150 from unintentionally sliding off the earphone housing 140. According to an embodiment, as illustrated in FIG. 8A, the friction enhancing means 180 may include an adhesive substance 800, such as, e.g., glue, which may be applied on at least a part of the boundary layer between the earphone housing 140 and the foldable sleeve 150.

According to some embodiments, the friction enhancing means 180 represented by an adhesive substance 800, such as, e.g., glue may be applied to an area in the boundary layer between the earphone housing 140 and the first end 160 of the foldable sleeve 150.

Figure 8B:
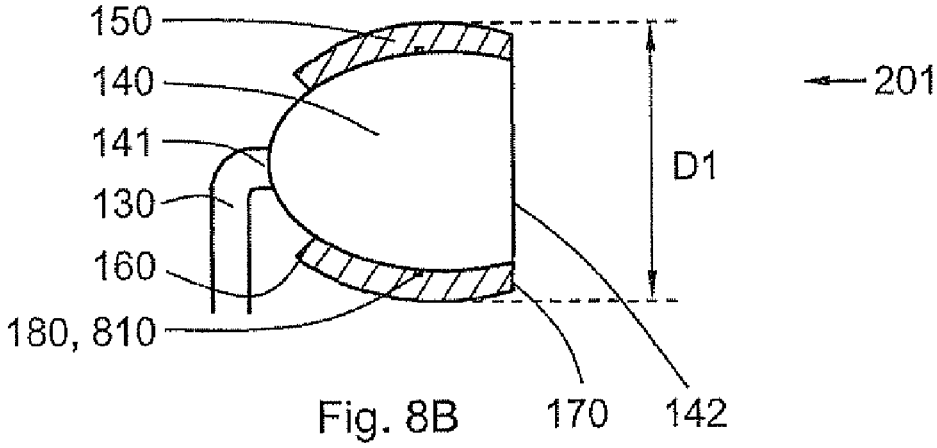
FIG. 8B is a cross section schematically depicting an embodiment of an exemplary earphone housing, with a foldable sleeve in a first unfolded position and an embodiment of friction enhancing means.

FIG. 8B schematically depicts a cross section of yet an embodiment of the earphone housing 140 with the foldable sleeve 150 in the first unfolded position 201 and an embodiment of friction enhancing means 180.

According to an embodiment, as illustrated in FIG. 8B, the friction enhancing means 180 may be represented by an external rib 810. The external rib 810 may, according to some embodiments, be elevated from the surface of the earphone housing 140, protruding from the outer surface of the earphone housing 140 as a ridge, as illustrated in FIG. 8B.

According to some embodiments, the earphone housing 140 may be provided with a plurality of external ribs 810, forming a high friction zone on the outer surface of the earphone housing 140, which may prevent the foldable sleeve 150 from unintentionally sliding off the earphone housing 140 (not shown). According to some embodiments, the foldable sleeve 150 may be provided with at least one incision, which at least one incision fits the at least one external rib 810.

According to some embodiments, the foldable sleeve 150 may be provided with one first incision, adapted to fit one first external rib 810 in the earphone housing 140 when the foldable sleeve 150 is arranged in the first unfolded position 201.

According to some embodiments, the foldable sleeve 150 may be provided with one second incision, adapted to fit one second external rib 810 in the earphone housing 140 when the foldable sleeve 150 is arranged in the folded position 203 (not shown).

Figure 8C:
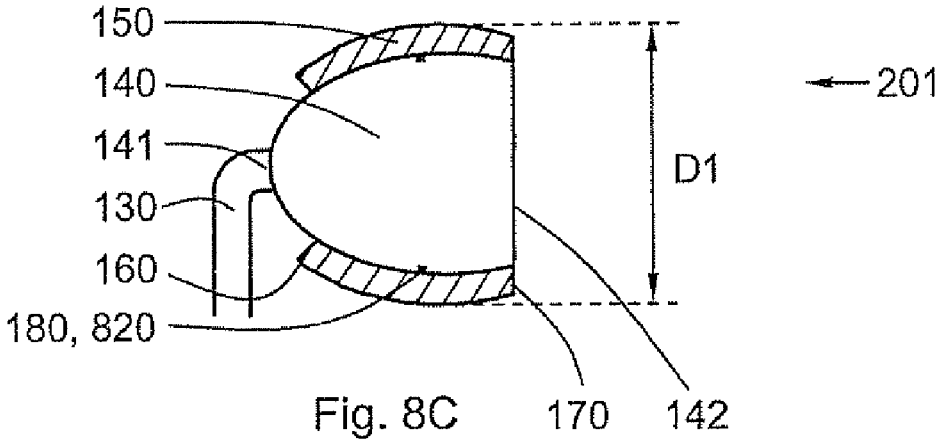
FIG. 8C is a cross section schematically depicting an embodiment of an exemplary earphone housing, with a foldable sleeve in a first unfolded position and an embodiment of friction enhancing means.

FIG. 8C schematically depicts a cross section of yet an embodiment of the earphone housing 140 with the foldable sleeve 150 in the first unfolded position 201 and an embodiment of friction enhancing means 180.

According to an embodiment, as illustrated in FIG. 8C, the friction enhancing means 180 may be represented by an external incision 820 in the earphone housing 140. The external incision 820 may, according to some embodiments, be a hollow cavity in the exterior surface of the earphone housing 140, circumventing the exterior surface earphone housing 140.

According to some embodiments, the earphone housing 140 may be provided with a plurality of external incisions 820, forming a high friction zone on the exterior surface of the earphone housing 140, which may prevent the foldable sleeve 150 from unintentional sliding. The plurality of external incisions 820 may be made, e.g., as a mesh grid on the exterior of the earphone housing 140 (not shown).

According to some embodiments, the foldable sleeve 150 may be provided with at least one rib, which at least one rib fits the at least one external incision 820 in the earphone housing 140 (not shown). According to some embodiments, the foldable sleeve 150 may be provided with one first rib, adapted to fit one first external incision 820 in the earphone housing 140 when the foldable sleeve 150 is arranged in a first unfolded position 201 (not shown). According to some embodiments, the foldable sleeve 150 may be provided with one second rib, adapted to fit one second external incision 820 in the earphone housing 140 when the foldable sleeve 150 is arranged in a folded position 203 (not shown).

By applying friction enhancing means 180, thus increasing the friction on the external surface of the earphone housing 140, the risk of loosing the foldable sleeve 150 due to unintentional slipping may be reduced.

Any of the friction enhancing means 180, as further discussed in connection to FIGS. 8A-8C may, according to some embodiments, be used together with the flexibility of the elastic material used in the foldable sleeve 150, which may further enhance the friction between the earphone housing 140 and the foldable sleeve 150.

However, according to some embodiments, the friction enhancing means 180 may include a high friction earphone housing 140 coating, such as, e.g., high friction rubber or a synthetic array of polypropylene fibers, which may be applied on the exterior surface of the earphone housing 140 (not shown).

The earphone housing 140 may be attached to the cable connection 130, which in turn may be attached to the portable electronic device 110. However, the earphone housing 140 may, according to some embodiments, not be connected to any device or cable 130 at all. According to some embodiments, the earphone housing 140 may be connected to the portable electronic device 110 by means of a wireless connection, such as, e.g., Bluetooth. According to yet some embodiments, the size adjustable earphone housing 140 may be used as an earplug, earmuff, hearing-protector or the like, reducing the disturbance from surrounding noise sources. Thus, the risk of impaired hearing due to exposure to surrounding high decibel noise may be reduced.

The inserted adjustable earphone housing 140 may be used, e.g., in order to avoid getting water into the ear when swimming, as a hearing protective device, reducing the risk of getting tinnitus, e.g., at concerts or the like, or in order to avoid ear block when making, e.g., aeronautical, mountainous, high speed, space craft, extra terrestrial, or submarine travels.

In one embodiment, the improved fit due to the size adaptable earphone housing 140 may allow for the sealing of the ear when using the size adaptable earphone housing 140 with the attached foldable sleeve 150. Thereby, an improved wearing consistency of the earphone housing 140 may be achieved, which may result in less movement of the earphone housing 140, less sound leakage, less disturbance from external noise sources, and improved sound quality. Thereby, it may be possible to reduce the sound level, which may reduce the risk of harming the sensitive auditory organs of the user. Also, less sound volume may result in lower power consumption of the portable electronic device 110, which may save energy resources and may prolong the operational lifetime of the battery of the portable electronic device 110 before recharge. Further, in one embodiment the foldable sleeve 150, which may be folded and thus providing an earphone housing 140 with a plurality of diametrical sizes, may allow for production resources to be saved compared with the existing solutions, including a plurality off loose sleeves that may be added to the earphone housing 140.

The size adaptable earphone housing 140 according to the invented solution may also be used as an obstruction against undesired social contact when plugged in, thus providing, e.g., a user with social phobia, or, e.g., a photographical model, a moment of relief from the harassment of social desperadoes.

Figure 9:
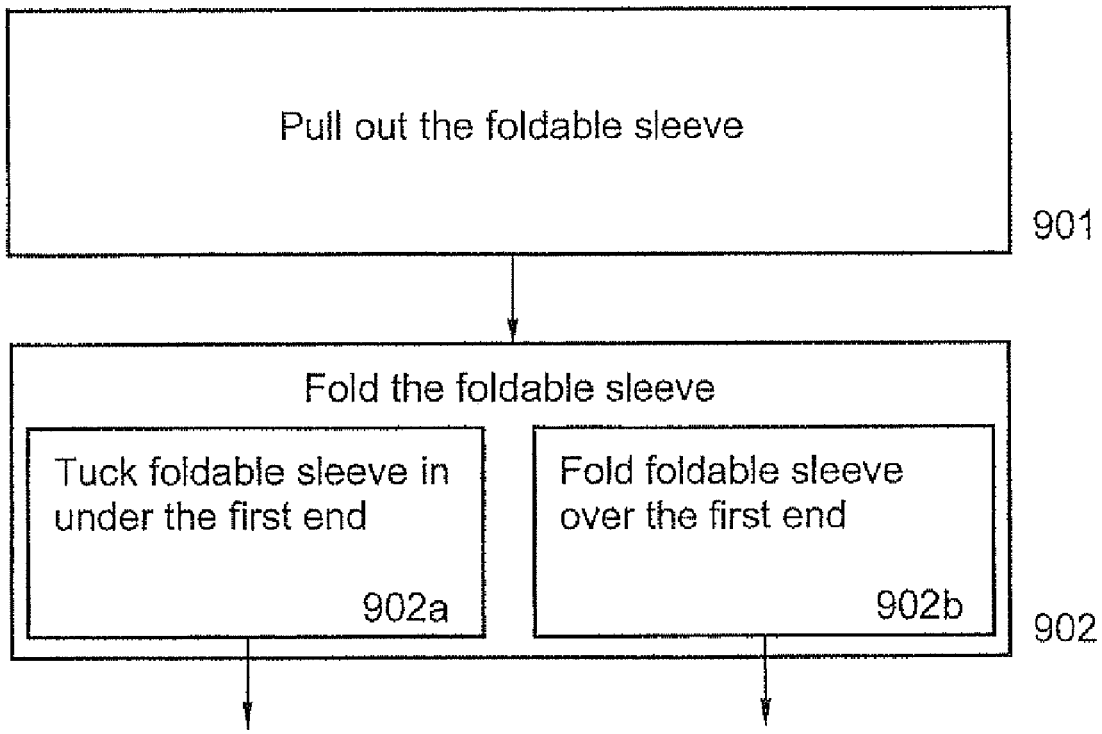
FIG. 9 is a flow chart illustrating an exemplary method for adjusting the size of an earphone housing.

FIG. 9 is a flow chart illustrating a method for adjusting the size of an earphone housing 140. The earphone housing 140 may include a foldable sleeve 150. The foldable sleeve 150 may include a first end 160 and a second, opposite end 170. The foldable sleeve 150 may be attached to the earphone housing 140 as previously explained. The second end 170 of the foldable sleeve 150 may be adapted to be folded. The method may be initiated when the earphone housing 140 including the foldable sleeve 150 is positioned in the first unfolded position 201, and the user desires to enlarge the resulting diametrical size D1 of the earphone housing 140 with the foldable sleeve 150 by positioning the foldable sleeve 150 of the earphone housing 140 in the folded position 203, thus achieving a second diametrical size D2 of the earphone housing 140 with the foldable sleeve 150. The second diametrical size D2 of the earphone housing 140 with the foldable sleeve 150 achieved in the folded position 203 may be larger than the first diametrical size D1 of the earphone housing 140 with the foldable sleeve 150 achieved in the first unfolded position 201.

To appropriately adjust the diametrical size D1, D2 of the earphone housing 140, the method may include a number of steps. One or more of the steps may be optional and may only be included in some embodiments. For example, the steps 902*a* and 902*b* may be alternatively optional. Further, the method steps 901-902 may be performed in any chronological order and some of them, e.g., step 901 and step 902, may be performed simultaneously or in an altered or even completely reversed chronological order. The method may include the following:

Step 901

The foldable sleeve 150 may be pulled out from the earphone housing 140, a distance approximately half as long as the length of the foldable sleeve 150. The pulling may be made such that the second end 170 of the foldable sleeve 150 may be pulled over the second open end 142 of the earphone housing 140.

Thus, the first end 160 of the foldable sleeve 150 may still be attached to the earphone housing 140, such as, e.g., embracing the earphone housing 140. The opposite second end 170 of the foldable sleeve 150, however, may become completely open and unattached to the earphone housing 140 through the described operation. According to some embodiments, step 901 may be performed by applying a pulling force to the second end 170 of the foldable sleeve 150, in a direction approximately perpendicular to the second open end 142 of the earphone housing 140, directed away from the earphone housing 140.

According to some embodiments, step 901 may be performed by applying a pushing force to the first end 160 of the foldable sleeve 150, in a direction approximately perpendicular to the second open end 142 of the earphone housing 140, directed towards the second end 170 of the foldable sleeve 150.

Step 902

The second end 170 of the foldable sleeve 150 may be folded backwards, towards the first end 160 of the foldable sleeve 150, thus providing the earphone housing 140 with the foldable sleeve 150 with a second diametrical size D2. The second diametrical size D2 may be larger than the previously described first diametrical size D1. The enlargement of the diametrical size D1, D2 of the earphone housing 140 with the foldable sleeve 150 may be possible, as the foldable sleeve 150 is folded. The operation may, according to some embodiments, be repeated so that the foldable sleeve 150 may be folded doubly, triple, four times, etc., until the desired diametrical size D2 of the earphone housing 140 may be achieved in order to properly fit the users ear.

According to some embodiments of the described method, the foldable sleeve 150 may be folded a plurality of times, e.g., rolled. Thus, the second end 170 of the foldable sleeve 150 may be bended backwards towards the first end 160 of the foldable sleeve 150. Thereafter, the body material of the foldable sleeve 150 may be wrapped around the second end 170 of the foldable sleeve 150, creating a torus shape. The enrolled torus shape may include some air, depending on the applied compression during the wrapping process. The air comprised within the enrolled torus thus may add further size, volume, adaptivity, flexibility and elasticity of the foldable sleeve 150, which may result in improved fit, comfort and wearing consistency for the user.

Step 902*a*

Step 902*a* may include tucking in the second end 170 of the foldable sleeve 150 under the first end 160 of the foldable sleeve 150, thus providing the earphone housing 140 with the foldable sleeve 150 with the second diametrical size D2.

Step 902*b*

Step 902*b* may include folding the second end 170 of the foldable sleeve 150 over the first end 160 of the foldable sleeve 150, thus providing the earphone housing 140 with the foldable sleeve 150 with the second diametrical size D2.

In one embodiment, the size adjustable earphone housing 140 may reduce the number of loose parts, such as separate sleeves or soft pads of different outer diameters. Thus, the risk of loosing any separate sleeves or soft pads may be reduced or even eliminated, as the sleeve 150 may be attached to the earphone housing 140. Also the production costs of producing such plurality of separate sleeves of different outer diameters, as well as natural resources, may be saved.

According to some embodiments, a user with asymmetrical ear sizes may apply the described method on one of the earphone housings 140, thus wearing one earphone housing 140 with the attached foldable sleeve 150 in the first unfolded position 201, and the other earphone housing 140 with the attached foldable sleeve 150 in the folded position 203. Thus, the present method and arrangement may enhance the well-being or quality of life of the physically asymmetrical user by providing an improved fitness of the earphone housings 140 to the ears of the user.

The foldable sleeve 150 attached to the earphone housing 140 may be in any color. The foldable sleeve 150 may to some extent be interchangeable, so that the color lo of the foldable sleeve 150 matches the color of the users dress, handbag, tie or other accessory of the user. However, the foldable sleeve 150 may, according to some embodiments, be interchangeable only with some difficulties involved, as the foldable sleeve 150 may be attached to the earphone housing 140 in order to reduce the risk of loosing the foldable sleeve 150. One embodiment may allow for the use of a specially designed tool for interchanging foldable sleeves 150, in order to simplify the exchange of foldable sleeve 150.

To use the foldable sleeve 150 with a personalized color may also simplify the identification process of the user, thus reducing the risk of mistaking, e.g., a friends set of portable hands free device 100. The foldable sleeve 150 attached to the earphone housing 140 may also be interchangeable for sanitary reasons. Thus it may be possible to detach the foldable sleeve 150 and disinfect it, or replace it.

One embodiment may provide an ergonomically improved fit to the ear of a large group of users. As the user may be given at least two different optional diametrical sizes D1, D2 to select from, more than 80% of the portable hands free 100 users may find an earphone housing 140 diametrical size D1, D2 that they are comfortable with.

One or more embodiments may include a size adjustable earphone housing. The earphone housing may be attached to a foldable sleeve. The foldable sleeve may include a first end and an opposite second end. The first end of the foldable sleeve may embrace the earphone housing. The opposite second end of the foldable sleeve may be adapted to be folded. The foldable sleeve may be adapted to be kept in a first unfolded position and in a folded position. The earphone housing with the foldable sleeve may be provided with a first diametrical size when the foldable sleeve is arranged in the first unfolded position. Further, the earphone housing with the foldable sleeve may be provided with a second diametrical size when the foldable sleeve is arranged in the folded position. One or more disclosures may also concern a method for adjusting size of an earphone housing and a portable hands free device comprising a size adjustable earphone housing.

The terminology used in the detailed description of the particular exemplary embodiments illustrated in the accompanying drawings is not intended to be limiting of the invention. In the drawings, like numbers refer to like elements.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include wirelessly connected or coupled. As used herein, the term "and/or" includes any and all combinations of one or more of the associated listed items.

Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The invention claimed is:

1. A size adjustable earphone comprising:
- a foldable sleeve attached to an earphone housing,
- where a first end of the foldable sleeve is coupled to the earphone housing,
- where an opposite, second end of the foldable sleeve is foldable,
- where the foldable sleeve is in one of:
  - a first, unfolded position in which the earphone housing including the foldable sleeve is associated with a first diametrical size, or
  - a second, folded position in which the earphone housing including the foldable sleeve is associated with a second diametrical size, and
- where the second diametrical size is larger than the first diametrical size.

2. The size adjustable earphone according to claim 1, where the earphone housing comprises:
- an external rib, protruding from an outer surface of the earphone housing, to enhance friction between the earphone housing and the foldable sleeve.

3. The size adjustable earphone according to claim 1, where the earphone housing comprises:
- an external incision in an outer surface of the earphone housing to enhance friction between the earphone housing and the foldable sleeve.

4. The size adjustable earphone according to claim 1, where the earphone housing comprises:
- an adhesive substance, applied in a boundary layer between the earphone housing and the foldable sleeve, to enhance friction between the earphone housing and the foldable sleeve.

5. The size adjustable earphone according to claim 1, where the foldable sleeve is applied as a coating over the earphone housing, the coating acting as a protective outer material to the earphone housing when the earphone housing is in the first, unfolded position.

6. The size adjustable earphone according to claim 1, where a difference between the first diametrical size and the second diametrical size is approximately 1 millimeter.

7. The size adjustable earphone according to claim 1, where the first diametrical size of the earphone housing is approximately between 3 and 30 millimeters.

8. The size adjustable earphone according to claim 1, where the foldable sleeve comprises one or more of:
- an elastic material,
- rubber,
- plastic, or
- silicone.

9. The size adjustable earphone according to claim 1, where the foldable sleeve is rolled into the second, folded position in which the earphone housing is associated with the second diametrical size.

10. The size adjustable earphone according to claim 1, where the foldable sleeve is folded with the second end of the foldable sleeve on top of the first end of the foldable sleeve when the foldable sleeve is in the second, folded position.

11. The size adjustable earphone according to claim 1, where the foldable sleeve is folded with the first end of the foldable sleeve on top of the second end of the foldable sleeve, when the foldable sleeve is in the second, folded position.

12. A method comprising:

adjusting a diametrical size of an earphone housing attached to a foldable sleeve, where a first end of the foldable sleeve is attached to the earphone housing, and where an opposite second end of the foldable sleeve is foldable, where the earphone housing, when the foldable sleeve is unfolded, is associated with a first diametrical size; and where the earphone housing, when the foldable sleeve is folded, is associated with a second diametrical size that is larger than the first diametrical size.

13. A method according to claim 12, comprising:

pulling out, before adjusting the diametrical size of the earphone housing, the foldable sleeve from the earphone housing, a distance approximately half as long as a length of the foldable sleeve.

14. A method according to claim 12, where folding the second end comprises:

tucking the second end of the foldable sleeve under the first end of the foldable sleeve to situate the second end of the foldable sleeve under the first end of the foldable sleeve.

15. A method according to claim 12, where folding the second end comprises:

folding the second end of the foldable sleeve over the first end of the foldable sleeve to situate the second end of the foldable sleeve over the first end of the foldable sleeve.

16. A portable hands-free device comprising:

an earphone including an earphone housing; and a sleeve attached to the earphone housing, where a first end of the sleeve is coupled to the earphone housing, where an opposite second end of the sleeve is to be folded, where, when the sleeve is in a first, unfolded position, the earphone housing is associated with a first diametrical size and when the sleeve is in a second, folded position, the earphone housing is associated with a second diametrical size, and where the second diametrical size is larger than the first diametrical size.

17. The portable hands-free device according to claim 16, where the earphone housing comprises a friction enhancing unit to enhance friction between the earphone housing and the sleeve.

18. An apparatus comprising:

an earphone including an earphone housing;

a sleeve attached to the earphone housing, where the sleeve includes a first end attached to the earphone housing and an opposite, second end that is not attached to the earphone housing; and means for allowing a folding of the second end of the sleeve toward the first end of the sleeve, where the earphone housing, when the sleeve is not folded, is associated with a first diametrical size and where the earphone housing, when the sleeve is folded, is associated with a second diametrical size.

19. The apparatus of claim 18, where the earphone housing comprises:

friction enhancing means for enhancing friction between the earphone housing and the sleeve.

20. The apparatus of claim 19, further comprising:

means for allowing a pulling of the sleeve from the earphone housing a distance approximately half as long as a length of the sleeve.

21. The method of claim 12, where adjusting the diametrical size of an earphone housing includes:

folding the second end of the foldable sleeve backwards, towards the first end of the foldable sleeve.

* * * * *